United States Patent [19]

Degen

[11] 4,118,811

[45] Oct. 10, 1978

[54] DEVICE FOR INCLINING THE SUPPORTING SURFACE OF A RECLINING FURNITURE

[75] Inventor: Hugo Degen, Seltisberg, Switzerland

[73] Assignee: Inpaver AG, Zug, Switzerland

[21] Appl. No.: 851,286

[22] Filed: Nov. 14, 1977

[30] Foreign Application Priority Data

Nov. 23, 1976 [CH] Switzerland ..... 14715/76

[51] Int. Cl.[2] ..... A61G 7/10

[52] U.S. Cl. ..... 5/62; 5/67

[58] Field of Search ..... 5/60–64, 5/664, 69

[56] References Cited

U.S. PATENT DOCUMENTS

| | | | |
|---|---|---|---|
| 3,797,050 | 3/1974 | Benoit et al. | 5/62 |
| 4,070,720 | 1/1978 | Edney | 5/62 |

FOREIGN PATENT DOCUMENTS

| | | | |
|---|---|---|---|
| 293,895 | 11/1967 | Australia | 5/62 |

*Primary Examiner*—Casmir A. Nunberg
*Attorney, Agent, or Firm*—Hans Berman

[57] ABSTRACT

A piece of furniture adapted to support a person in a reclining position includes a base and a mattress support that may be tilted on the base about an axis near the head end of the support. The position of the foot end and the resulting inclination of the supporting surface may be varied by means of a spacer arrangement which includes two hangers pivotally suspended from the mattress support near the foot end. One or two spacer members are secured to the free, lower end portions of the hangers for angular movement about a horizontally extending axis. Stops keep the center of gravity of the spacer or spacers above the last-mentioned axis and limit its angular movement. A friction brake prevents gravity from affecting the angular position of the spacer on the hanger or hangers. When the spacer is in a position in which its center of gravity is vertically aligned with the pivoting axis of the hangers, its downwardly directed face may be engaged by an abutment on the base for angular movement on the hangers when the foot end of the support moves toward the base. Mutual lifting and setting down of the foot end adjusts the spacer arrangement to hold the supporting surface alternatively horizontal or upwardly sloping toward the foot end.

7 Claims, 22 Drawing Figures

FIG. 5
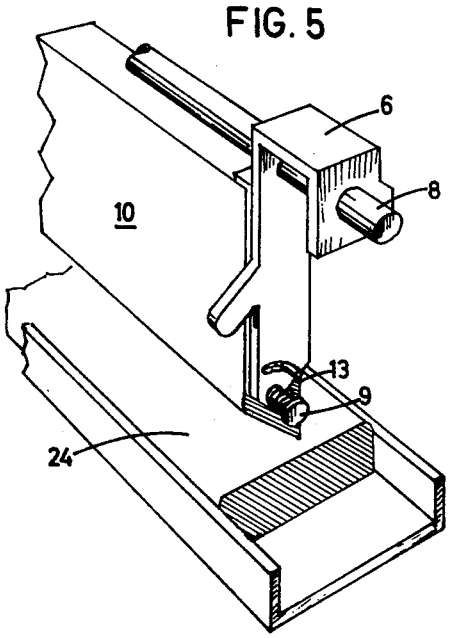
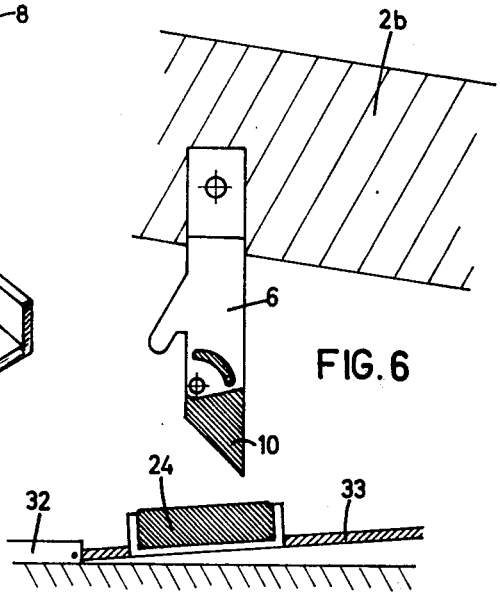
FIG. 6
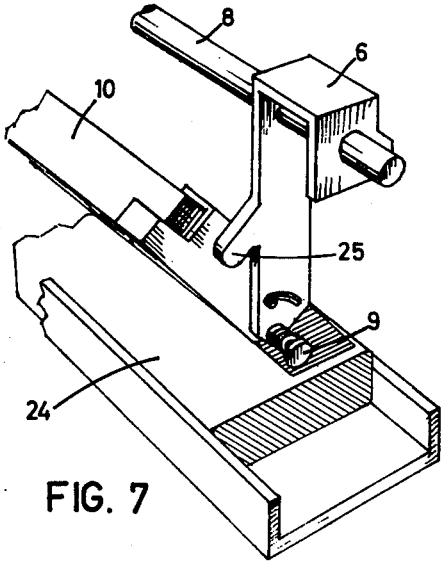
FIG. 7
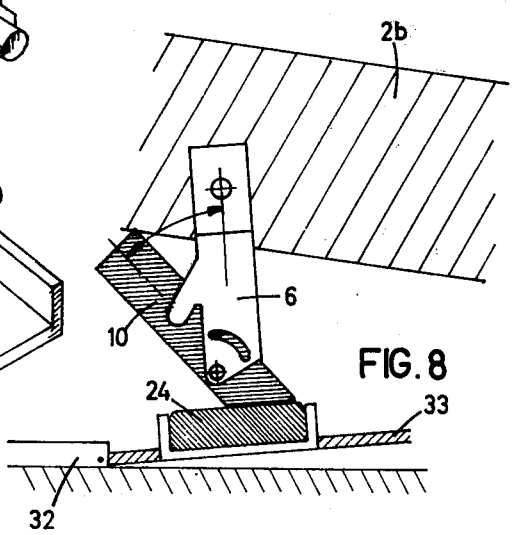
FIG. 8

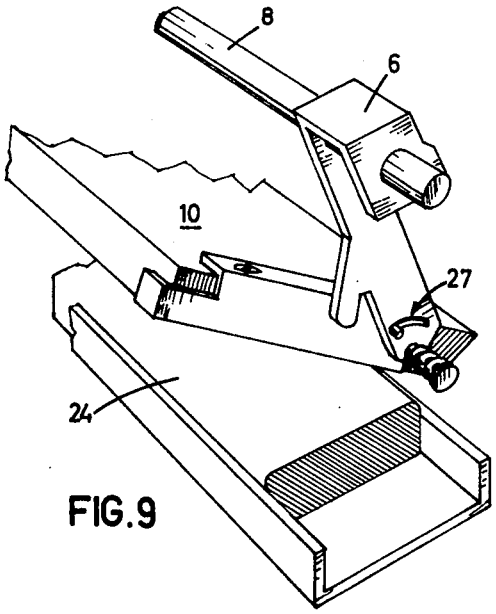
FIG.9
FIG. 10
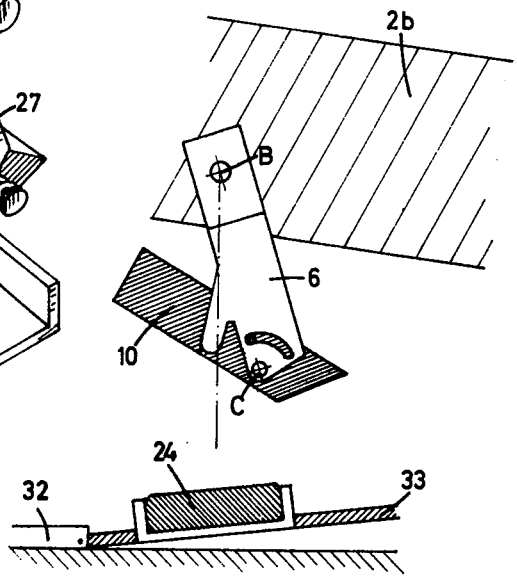
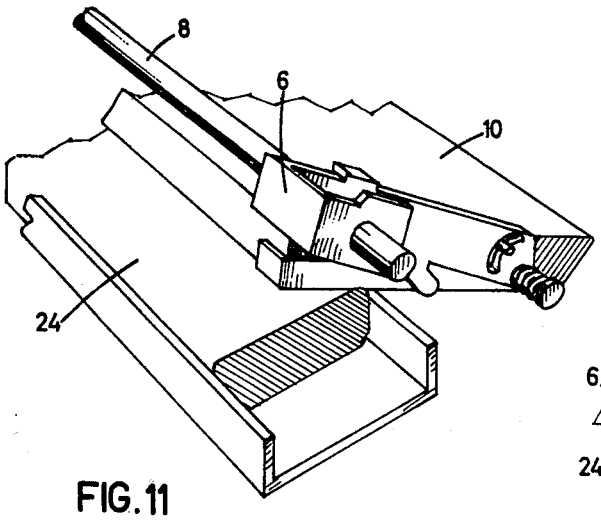
FIG.11
FIG. 12
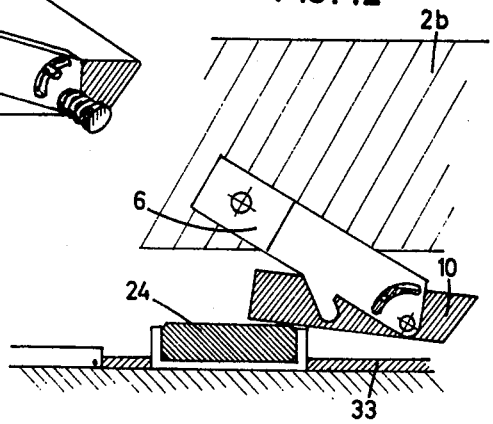

DEVICE FOR INCLINING THE SUPPORTING SURFACE OF A RECLINING FURNITURE

This invention relates to furniture adapted to support a person in a reclining position, and more particularly to a piece of furniture whose supporting surface may be held alternatively in a practically horizontal position and a "feet-up" position in which the foot end of the surface is located above the head end.

It has long been recognized that reclining on a piece of furniture which holds the feet in an elevated position is relaxing, and known pieces of furniture are equipped to provide a supporting surface which may be adjusted between a practically horizontal position and a position in which the surface slopes upward toward the foot end. The adjusting mechanisms of the known furniture pieces are relatively difficult to operate.

The primary object of this invention is a piece of furniture whose supporting surface may be tilted in the manner described by a mechanism which is of simple construction and simple and safe to operate.

The invention provides a piece of furniture including a support defining the inclination of a hoirzontally extending support surface for a person. One portion of the support is superposed on a base of the piece for tilting movement about a first, horizontally extending axis. Another portion of the support, spaced from the one portion transversely to the tilting axis, moves toward and away from the base during the tilting movement. A spacer arrangement on the other support portion limits movement of the other support portion toward the base in several alternative positions. It includes a hanger secured to the other portion for pivotal movement about a second, horizontally extending axis. A free end portion of the hanger is downwardly spaced from the second axis. A spacer member is secured to the free end portion for angular movement about a third, horizontally extending axis. Stops keep the center of gravity of the spacer member above the third axis and limit its angular movement. A friction brake interposed between the hanger and the spacer member prevents angular movement of the spacer member in response to gravity alone. The spacer member has a downwardly directed abutment face which is obliquely inclined to the vertical in a plane perpendicular to the third axis in a position of the spacer member in which its center of gravity is vertically aligned with the second axis. An abutment on the base engages the abutment face and thereby causes angular movement of the spacer member about the third axis when the spacer member is in the aforedescribed position during movement of the other support portion toward the base.

The attached drawing illustrates preferred embodiments of the invention.

FIG. 5 is a fragmentary, perspective view of the device of FIG. 2 in a first operating position;

FIG. 6 shows the device of FIG. 5 and associated elements in side elevation;

FIGS. 7, 9, 11, 13 and 15 show the device of FIG. 5 in respective other operating positions in perspective views;

Figure 17:
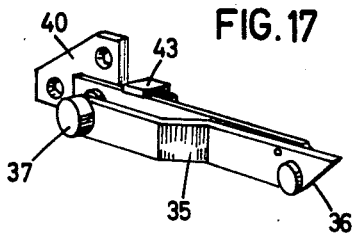
Figure 18:
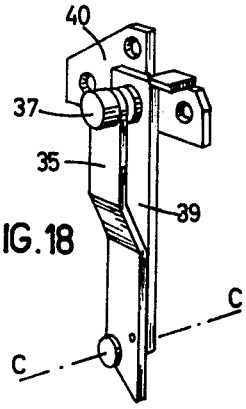
Figure 19:
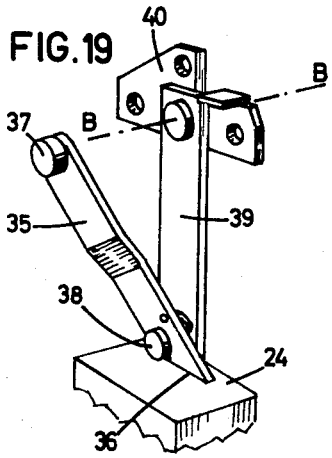
Figure 20:
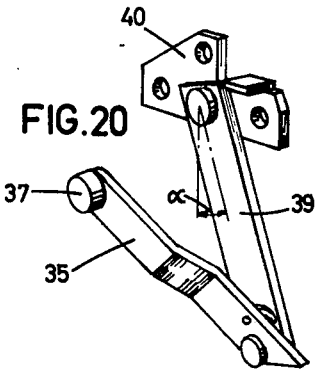
Figure 21:
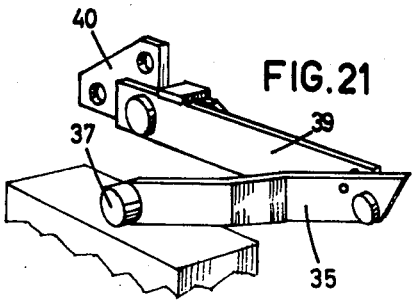
Figure 22:
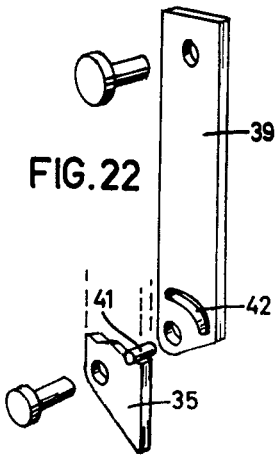

FIGS. 8, 10, 12, 14, and 16 show the device of FIGS. 7, 9, 11, 13 and 15 in corresponding side-elevational views;

FIG. 17 illustrates a second embodiment of the invention in a fragmentary, perspective view;

FIGS. 18 to 21 illustrate the device of FIG. 17 in respctive, different operating positions; and FIG. 22 shows elements of the same device in a fragmentary, exploded perspective view.

Figure 1:
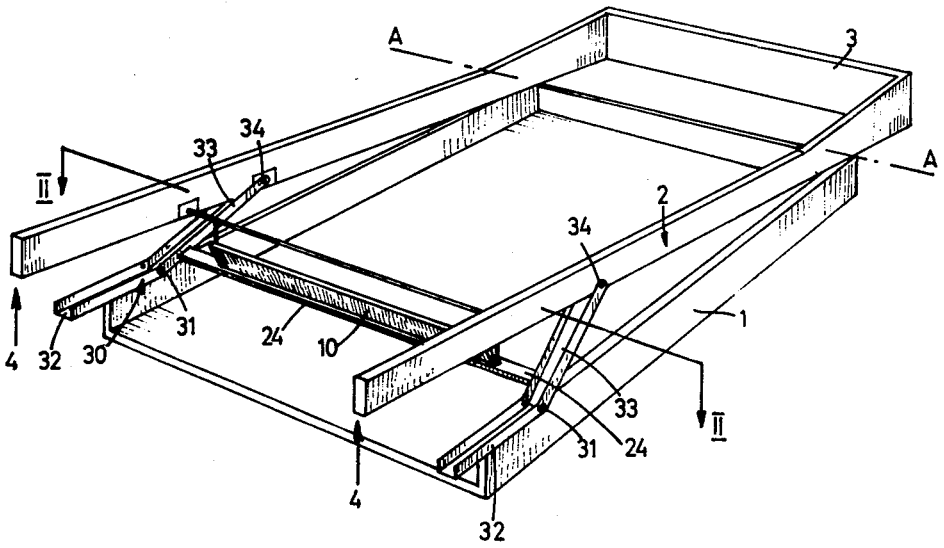
FIG. 1 shows a piece of furniture according to the invention in fragmentary, perspective view.

FIG. 1 shows only as much of a piece of furniture as is necessary for an understanding of the invention. The piece has a base 1 on which an elongated frame 2 is superposed. The two longitudinal frame members 2*a*, 2*b* (see FIG. 2) are normally connected transversely by slats on which a mattress rests, the slats and mattress having been omitted for the sake of clarity. The head portion 3 of the frame 2 is raised and may be tilted on the frame 2 about a first horizontal axis A—A. The foot end of the frame, partly broken away, has been raised in the direction of arrows 4 so that the supporting surface of the non-illustrated mattress, whose inclination is defined by the frame 2, slopes upward from the head portion 3 toward the foot portion.

Figure 2:
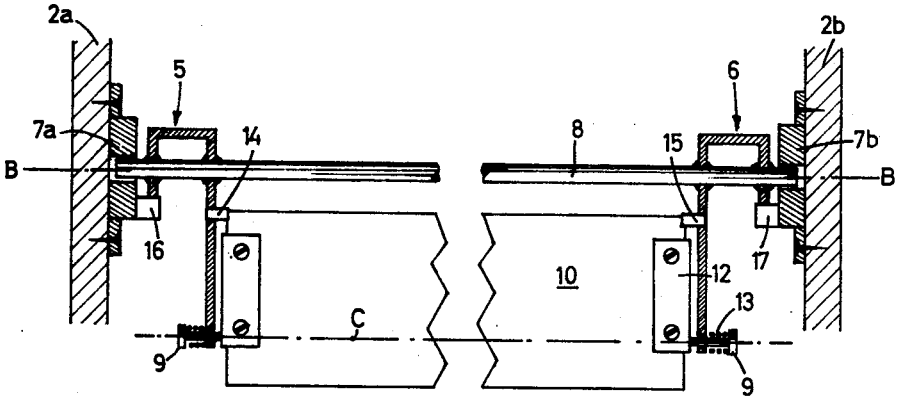
FIG. 2 illustrates the piece of FIG. 1 in fragmentary section on the line II — II.

As is better seen in FIG. 2, two hangers 5,6 are welded to a rod 8 in spaced relationship, and the two ends of the rod are journaled in bearing blocks 7*a*, 7*b* on the longitudinal frame members 2*a*, 2*b*. Each hanger is a section of a channel having two flanges of different width. A wooden spacer slat 10 is attached between the free lower ends of the wider flanges by bolts 9. As is evident from each of FIGS. 4 to 16, the longitudinal bottom edge face 11 of the slat 10, not visible in FIG. 2, is inclined relative to the vertical at an angle of 45° in the position of the slat illustrated in FIG. 2 in which the center of gravity of the slat is aligned with the pivot axis B—B of the rod 8.

The slat 10 may move angularly on the hangers 5,6 about the common horizontal axis C of the bolts 9 which is parallel to the afore-mentioned axes A—A and B—B. The center of gravity of the slat is above the axis C. As is shown in greater detail in FIGS. 3 and 4, a fitting 12 is attached to each end of the slat 10, and the shank of each bolt 9 passes sequentially through a helical compression spring 13 and a bore in the associated hanger 5,6 into the fitting 12 so that the spring 12 is held between the head of the bolt 9 and the associated hanger and frictionally connects the hanger with the fitting 12 with a braking force sufficient to prevent gravity from turning the slat 10 on the hangers 5,6. Stops 14,15 on the hangers (see FIG. 2) limit angular movement of the slat 10 about the axis C.

Figure 3:
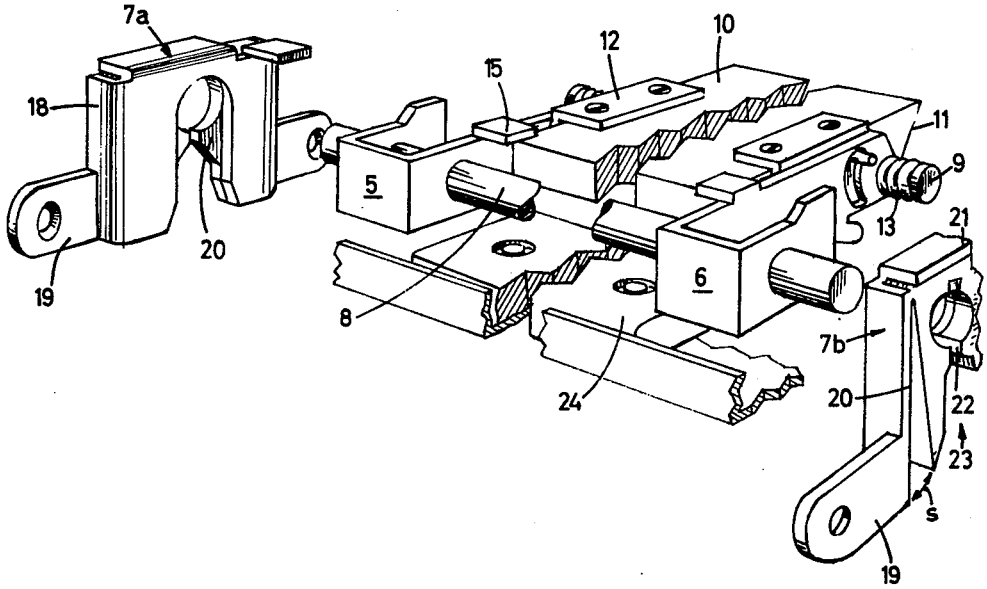
FIGS. 3 and 4 show elements of the device of FIG. 2 in exploded, fragmentary, perspective views.
Figure 4:
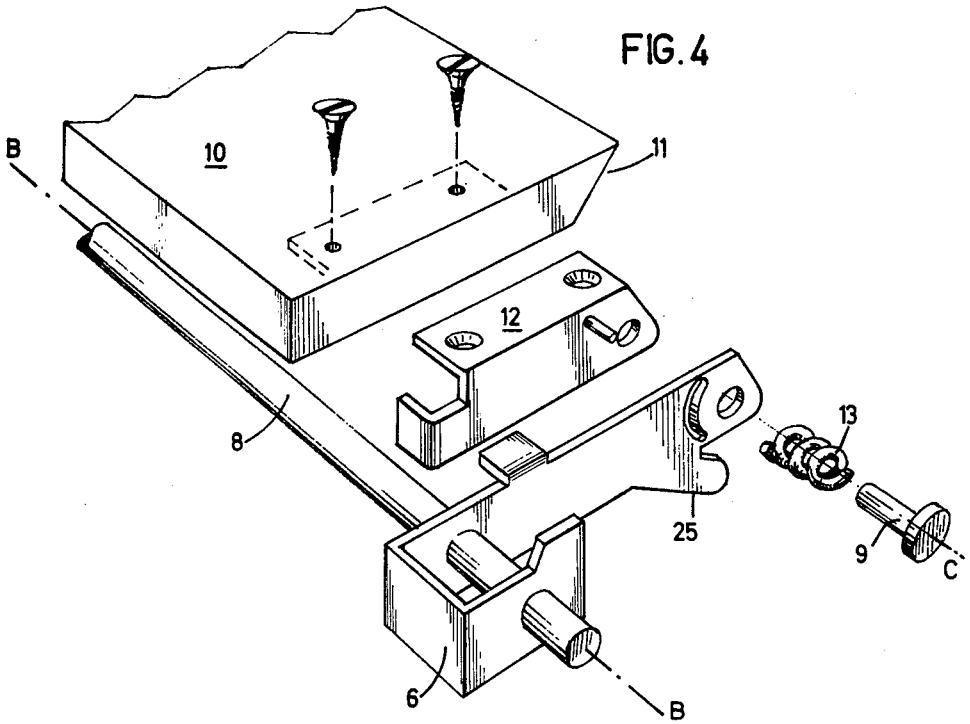

The rod 8 with the hangers 5,6 may swivel freely about the axis B—B within limits set by stops 16,17 on the bearing blocks 7*a*, 7*b*. As is best seen in FIG. 3, each bearing block has a sheet metal housing 18 attached to the frame 2 by means of lugs 19 and enclosing a nylon insert 20. Each end of the rod is journaled in a hole 21 of an insert 20, and may be introduced into the hole in the direction of an arrow 23 through an outwardly flaring, radial slot 22. The necessary resilient deformation of the insert 20 is made possible by a clearance space *s* between the insert 20 and the housing 18.

Sequential operating positions of the slat 10 and of associated elements are illustrated in the perspective views of FIGS. 5, 7, 9, 11, 13, and 15, and in the corresponding side-elevational views of FIGS. 6, 8, 10, 12, 14, and 16.

In the position also illustrated in FIG. 2 and further shown in FIGS. 5 and 6, the frame 2 was lifted manually as indicated by the arrows 4 so that the hangers 5,6 and the slat 10 depend freely in a vertical plane through the axis B—B. The slat 10 is held in position relative to the hangers by the braking action of the spring 13.

When the frame 2 is permitted to descend from the position of FIGS. 2,5,6 toward that of FIGS. 7 and 8, the lower edge of the slat 10 engages an abutment bar 24 mounted on the base 1 (FIG. 1) in a manner to be described hereinbelow in more detail. The weight of the frame 2 causes the slat 10 to pivot on the bolts 9 until the edge face 11 lies flat on the bar 24. When the frame 2 is released, it is held in the "feet-up" position by the slat 10.

When the frame 2 thereafter is lifted again into the position shown in FIGS. 9 and 10, the relative angular position of the slat 10 and the hangers 5,6 is maintained by the springs 13. This position is defined by a stop arrangement 27 yet to be described. The slat 10 and hangers 5,6 depend freely from the rod 8 in a position in which their common center of gravity is vertically aligned with the axis B—B.

Figure 13:
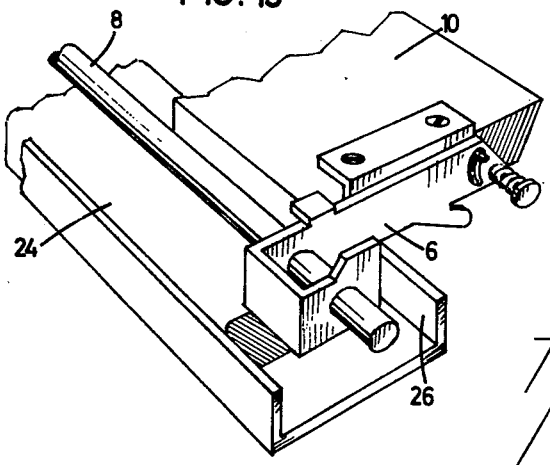
Figure 14:
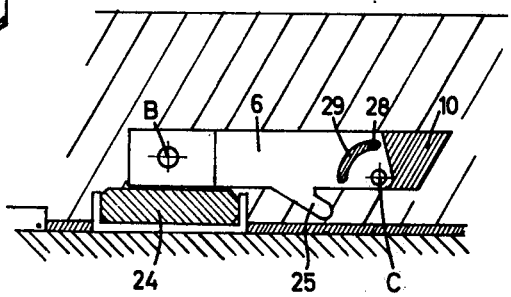

Lowering of the frame 2 from the position of FIGS. 9,10 causes one of the major side faces of the slat 10 to engage the bar 24 so that the weight of the frame 2 causes the slat to move on the hangers 5,6 through an intermediate position illustrated in FIGS. 11 and 12 into the position shown in FIGS. 13 and 14, in which the side face of the slat 10 lies flat on the top face of the bar 24, and the relative position of the slat and hangers relative to the axis C is the same as in FIGS. 2,5 and 6. The supporting surface of the piece of furniture now is approximately horizontal, and the "feet-up" position may be restored by lifting the foot end of the frame 2 and lowering it again.

If it is desired to raise the foot end of the frame 2 to a position intermediate the "feet-up" position and the horizontal position, the frame 2 is lifted from the position of FIGS. 13 and 14 only until a hook-shaped projection 25 on each hanger 5,6 clears a flange of a channel 26 in which the bar 24 is held. When the frame 2 thereafter is released, the projections 25 hold it in the intermediate position.

Figure 15:
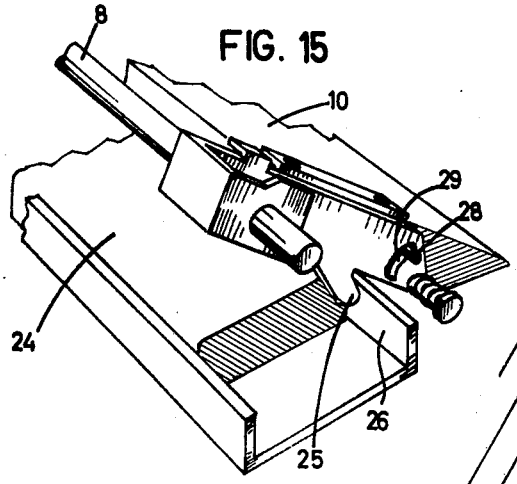
Figure 16:
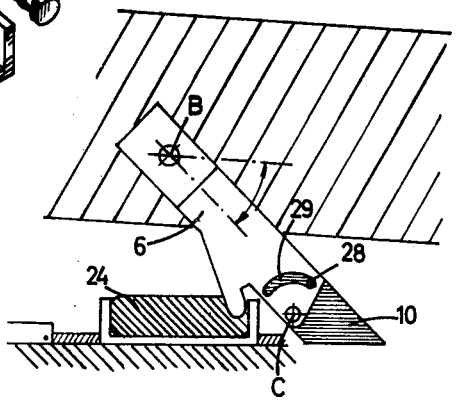

As is best seen in FIGS. 14 to 16, the afore-mentioned stop arrangement 27 consists of a pin 28 on each end of the slat 10 and received in a slot 29 of each hanger 5,6 which is circularly arcuate about the axis C.

FIG. 1 shows a support 30 associated with each end of the abutment 24. Each support consists of two channel sections 32,33 hingedly connected end-to-end at 31. The section 33 is hinged to the frame 2 at 34 while the section 32 slides freely on the base 1. The channel 26 holding the bar 24 is fastened between the two channel sections 33. The abutment assembly as well as the spacer assembly may thus be installed in existing furniture.

The rod 8 causes the hangers 5,6 to move in unison, but this is not absolutely necessary, and a modified spacer arrangement having two independent hangers and two independent spacer members is shown in FIGS. 17 to 22. A set of one hanger and one spacer member is mounted on each frame member 2*a*, 2*b*, and only one set will be described, the other one being a mirror image of the illustrated structure.

The modified spacer is a flat steel bar 35 having an obliquely transverse lower end face 36 and carrying a counterweight 37 at its top end. A pin 38 (FIG. 19) attaches the lower end of the spacer 35 to a corresponding end of a hanger 39 and carries a braking spring analogous to the afore-described springs 13, but not shown again. The braking action of the non-illustrated spring prevents angular movement of the spacer 35 on the hanger 39 under the force of gravity. The top end of the hanger 39 is pivotally attached to the frame 2, not itself shown in FIGS. 17 to 22, by means of a fitting 40 and a bolt. Relative angular movement of the spacer 35 and hanger 39 is limited by a projection 41 on the spacer received in an arcuate slot 42 of the associated hanger.

The spacer arrangement shown in FIGS. 17 to 22 functions substantially as described with reference to FIGS. 1 to 16. When the frame 2 is raised from its horizontal position, the two spacers 35 and hangers 39 swing into the vertical position shown in FIG. 18, and the spacer is turned by engagement of its end face 36 with the abutment bar 24 about the pin 38 into the position illustrated in FIG. 19 when the frame 2 is again lowered. Further angular displacement of the spacer 35 on the pin 38 is prevented by the projection 41 in the slot 42, and the frame is securely held in the "feet-up" position. When it is desired to return the frame to its horizontal position, its foot end is raised so that the spacer 35 and hanger 39 swing into the position of FIG. 20, thereafter to move through the positon of FIG. 21 into that of FIG. 17 when the frame 2 is lowered again.

A piece of furniture equipped with a spacer arrangement of the invention may thus be shifted between a horizontal position and a sloping position of its supporting surface by merely raising and lowering the foot end of its mattress-supporting frame. Existing furniture may be modified by installing the spacer arrangement.

I claim:

1. A piece of furniture adapted to support a person in a reclining position comprising:

(a) a base;

(b) a support defining the inclination of a horizontally extending support surface for said person, (1) said support having two portions spaced in a horizontal direction, (2) one of said portions being superposed on said base for tilting movement about a first, horizontally extending axis transverse to said direction, (3) the other portion moving toward and away from said base during said tilting movement;

(c) spacer means on said other portion for limiting movement of said other portion toward said base in a plurality of alternative positions, said spacer means including (1) a hanger member secured to said other portion for pivotal movement about a second, horizontally extending axis, said hanger member having a free end portion downwardly spaced from said second axis in at least one of said alternative positions, (2) a spacer member secured to said free end portion for angular movement about a third, horizontally extending axis, (3) stop means keeping the center of gravity of said spacer member above said third axis and limiting said angular movement, and (4) friction means interposed between said members for preventing said angular movement of said spacer member in response to gravity acting on said spacer member, (i) said spacer member having an abutment face downwardly directed in a position of said spacer member in which said center of gravity is vertically aligned with said second axis; and (d) abutment means on said base engaging said abutment face and thereby causing said angular movement of the spacer member when said spacer member is in said position thereof during movement of said other portion toward said base.

2. A piece of furniture as set forth in claim 1, wherein said abutment face is obliquely inclined to the vertical in a plane perpendicular to said third axis in said position of said spacer member.

3. A piece of furniture as set forth in claim 2, wherein said support is elongated in said horizontal direction, and said first and second axes are substantially parallel.

4. A piece of furniture as set forth in claim 2, wherein said spacer member has another face substantially vertical in said position of said spacer member, said other face abuttingly engaging said abutment means during movement of said other portion toward said base after the angular movement of said spacer member caused by engagement of said abutment face with said abutment means.

5. A piece of furniture as set forth in claim 1, wherein said spacer means further include an elongated rod member mounted on said other portion for pivotal movement about said second axis, said hanger member being fixedly fastened to one longitudinal portion of said rod member, and a second hanger member fixedly fastened to another longitudinal portion of said rod member spaced from said one portion of the same, said second hanger member having a free end portion downwardly spaced from said second axis and secured to said spacer member for angular movement of the spacer member about said third axis relative to said second hanger member.

6. A piece of furniture as set forth in claim 5, further comprising two bearing members fixedly mounted on said other portion, a part of each bearing member consisting of resiliently deformable material and being formed with a hole receiving a respective longitudinally terminal portion of said rod, said part being further formed with a slot communicating with said hole and open in a direction radially outward relative to said second axis to permit introduction of said longitudinally terminal portion into said hole.

7. A piece of furniture as set forth in claim 1, further comprising a projection on said hanger member and engagement means on said base engageable with said projection in one of said alternative positions for securing said support.

* * * * *